US007410416B2

(12) United States Patent
Fettkether

(10) Patent No.: US 7,410,416 B2
(45) Date of Patent: Aug. 12, 2008

(54) PLASTIC HVAC COMPONENT SYSTEM AND METHOD FOR INSTALLING THE SAME

(75) Inventor: Keith J. Fettkether, Readlyn, IA (US)

(73) Assignee: Fettkether L.L.C., Readlyn, IA (US)

( * ) Notice: Subject to any disclaimer, the term of this patent is extended or adjusted under 35 U.S.C. 154(b) by 189 days.

(21) Appl. No.: 11/254,844

(22) Filed: Oct. 20, 2005

(65) Prior Publication Data

US 2006/0199505 A1 Sep. 7, 2006

Related U.S. Application Data

(63) Continuation-in-part of application No. 11/053,087, filed on Feb. 8, 2005.

(51) Int. Cl.
*F24F 13/04* (2006.01)

(52) U.S. Cl. ..... 454/265; 454/332; 454/333

(58) Field of Classification Search ..... 454/334, 454/333, 332, 265

See application file for complete search history.

(56) References Cited

U.S. PATENT DOCUMENTS

| | | | | | |
|---|---|---|---|---|---|
| 2,131,804 | A | * | 10/1938 | Holub | 285/182 |
| 3,985,158 | A | * | 10/1976 | Felter | 138/149 |
| 4,735,235 | A | * | 4/1988 | Anderson et al. | 138/109 |
| 4,750,411 | A | * | 6/1988 | Eversole | 454/292 |
| 5,095,942 | A | * | 3/1992 | Murphy | 137/561 A |
| 5,219,403 | A | * | 6/1993 | Murphy | 137/561 A |
| 5,957,506 | A | | 9/1999 | Stepp | |
| 6,029,505 | A | * | 2/2000 | Webb | 73/40.5 R |
| 6,173,997 | B1 | * | 1/2001 | Nordstrom et al. | 285/139.1 |
| 6,203,074 | B1 | * | 3/2001 | Daniel | 285/424 |
| 6,231,704 | B1 | * | 5/2001 | Carpinetti | 156/71 |
| 6,273,145 | B1 | | 8/2001 | Botting | |
| 6,652,375 | B2 | | 11/2003 | Donnelly | |
| 2003/0051764 | A1 | | 3/2003 | Jungers | |
| 2006/0061104 | A1 | | 3/2006 | Jungers | |

OTHER PUBLICATIONS

Heating & Cooling Products "Heating and Cooling Projects Are made Easy With our Do-It-Yourself Guide" (1 page) brochure.
Champion Furnace Pipe Co. "Furnace Pipe, Duct & Fittings" No. 98 Booklet (36 pages).
Gary Metal Mfg. LLC "Air Distribution Products" (Mar. 2003) Booklet (36 pages).

* cited by examiner

*Primary Examiner*—Derek S. Boles
(74) *Attorney, Agent, or Firm*—McKee, Voorhees & Sease, P.L.C.

(57) ABSTRACT

A complete plastic HVAC system assembled using individual plastic components for ensuring the efficient and quiet distribution of air from a central air unit to multiple distribution points and preventing heating and cooling losses, the need for installers to stock multiple sized and shaped components, the accumulation of dust, dirt and pollens during storing, installing and use on the surfaces of the individual components. The fittings have a collar sizable to fit both 6 and 7-inch pipe, whether flexible or rigid. The use of plastic fittings, duct and pipe removes the potential of injury commonly associated with conventional metal ductwork, while providing seamless components that can be configured for any type of installation and insure an air tight connection between adjoining surfaces. The individual fittings include a register boot, torpedo boot, straight boot, rigid and flexible pipe and couplers, straight and 90-degree takeoffs, a plastic duct and duct end cap.

16 Claims, 7 Drawing Sheets

PLASTIC HVAC COMPONENT SYSTEM AND METHOD FOR INSTALLING THE SAME

CROSS-REFERENCE TO RELATED APPLICATIONS

This application is a continuation-in-part of U.S. application Ser. No. 11/053,087 filed Feb. 8, 2005, which application is a non-provisional U.S. application.

BACKGROUND OF THE INVENTION

The present invention relates to heating and cooling. More particularly, but without limitation, the present invention relates to a complete plastic HVAC component system for distributing air and method for installing the same.

A problem of common interest in heating and cooling is efficiency. Increasing the efficiency of a heating and cooling system results in decreased costs of operating the heating and cooling system. A key aspect contributing to the efficiency or inefficiency of a heating and cooling system is the heat and cooling losses incurred as air travels from the furnace through the ductwork and ultimately to the distribution points.

Conventionally, the ductwork between the furnace and the distribution points have been formed of sheet metal. Ducts or pipes as well as fittings such as elbows, angles, couplers and boots are formed of riveted or welded sheet metal. Due to the nature in which these various parts are made there are often cracks in the ductwork and between the associated fittings that result in heating or cooling loss. Cracks can result in an undesirable whistling sound and provide an opening for insects to access the inside of the ductwork.

In more recent times, flex pipe is replacing sheet metal ducts. Flex pipe is generally associated with less heat loss and is easier to handle than conventional sheet metal ductwork.

Another problem relates to installation of ductwork. Metal ductwork often presents sharp edges and corners to work around to prevent injuries from resulting.

A further problem relating to sheet metal ductwork is that it inherently collects dust and dirt on it's surface. In high humidity environments the surface of the sheet metal sweats collecting dust and dirt. A thin film of oil on the sheet metal's surface that is developed during manufacturing also collects unwanted dust and dirt particles during assembly and use.

Another problem relating to installation and repair is inventory. Ductwork can be of various sizes, including ducts being of 6 inch diameter or 7 inch diameter. Corresponding fittings come in 6 inch or 7 inch diameter, although reducers are available. The difference in diameters of ductwork requires that those who stock ductwork to carry inventory for both dimensions. This can be of particular concern to those who install or replace ductwork as they either need to maintain a full inventory of parts.

An additional problem relating to the use of sheet metal to form the ductwork and various components is the probability of incurring damage when dropped. Sheet metal components, ductwork and their connections risk becoming increasingly inefficient if dropped or subjected to excessive force during handling or installation.

Therefore, it is a primary object, feature, or advantage of the present invention to improve upon the state of the art.

It is a further object, feature, or advantage of the present invention to provide a complete plastic HVAC component system capable of efficiently delivering air from a furnace to distribution points having a limited number of fittings.

It is a further object, feature, or advantage of the present invention to provide for a complete plastic HVAC component system having individual fittings capable of use with square and round ductwork.

It is a further object, feature, or advantage of the present invention to provide for improved connections between a furnace, the ductwork and the registers to reduce losses and improve efficiency.

Another object, feature, or advantage of the present invention is to provide plastic fittings that can be adapted to accommodate ductwork having different diameters.

A further object, feature, or advantage of the present invention is to provide plastic fittings that reduce the amount of inventory needed.

A still further object, feature, or advantage of the present invention is to eliminate sharp metal edges which can result in injury.

Yet another object, feature, or advantage of the present invention is to provide fittings suitable for use with flex pipe.

A still further object, feature, or advantage of the present invention is to provide fittings that are seamless and without cracks that leak air and allow insects access.

Another object, feature, or advantage of the present invention is to provide fittings that are quiet and do not generate a whistling sound.

Yet another object, feature, or advantage of the present invention is to provide fittings with a flange or lip to stabilize the fittings during installation.

A further object, feature, or advantage of the present invention is to provide rigid fitting and/or flexible fittings that do not require an adapter to couple to different size piping.

A further object, feature, or advantage of the present invention is to provide a system of HVAC components, fittings and connectors resistant against damage during storing, handling and connecting.

A further object, feature, or advantage of the present invention is to provide a system of HVAC components, fittings and connectors resistant to sweating in high humidity environments.

A further object, feature, or advantage of the present invention is to provide a system of HVAC components, fittings and connectors resistant against dust, dirt and pollen collection during storing, handling and use.

A further object, feature, or advantage of the present invention is to provide a system of HVAC components, fittings and connectors and a method for installing the same.

One or more of these and/or other objects, features, or advantages of the present invention become apparent from the specification and claims that follow.

SUMMARY OF THE INVENTION

The present invention provides a complete plastic HVAC component system for distributing air and method for installing the same. According to one aspect of the present invention, individual plastic components, of complimentary shapes and sizes, provide a system for creating ductwork to channel air from a central air unit to multiple distribution points. The individual plastic components include torpedo boots, register boots, straight boots, flexible joints, solid pipes, duct runners and end caps, couplers, 90-degree takeoffs and straight takeoffs. The boots, flexible joint, coupler, solid pipe, 90-degree and straight takeoffs are formed of a unitary body of plastic. The boots have a unitary body with a substantially circular first opening for connecting to a flexible joint, solid pipe or flexible pipe and a substantially rectangular second opening for connecting to a register. The unitary body of the boot defines an air pathway between the first opening and the second opening. The unitary body can be adapted for connection to either a flexible joint, solid pipe, coupler or flexible duct each having a first diameter or a second diameter. The solid pipe, coupler, flexible joint and flexible pipe each have a unitary body with a substantially circular first opening and second opening for connecting to each other, a boot or a duct runner. The unitary body of the solid pipe, coupler, flexible joint and flexible pipe defines an air pathway between the first opening and the second opening. The unitary body can be adapted for connection to each other, a boot, a top and a side takeoff each having a first diameter or a second diameter. The 90-degree takeoffs and straight takeoffs are formed of a unitary body of plastic. The takeoffs have a unitary body with a substantially circular first opening for connecting to a flexible joint, solid pipe or flexible pipe and a substantially rectangular second opening for connecting to a duct runner. The unitary body of the takeoffs defines an air pathway between the first opening and the second opening. The first opening can be adapted for connection to either a flexible joint, solid pipe, coupler or flexible duct of a first diameter or a second diameter. The duct runner is formed of a sheet of plastic with sufficient thickness to resist damage during assembly, storing or installation. The plastic sheet is scored along the length of the sheet to create a hinged profile and allow for folding. A preferable method of assembling the duct runner is completed by folding the plastic sheet along the scorings, creating a rectangle shape and siliconing and screwing the raised flange to the second connecting edge. Once assemble, the duct runner is a unitary body of plastic having a substantially rectangular first and second opening for connecting to another duct runner, plenum chamber or end cap. The duct runner can also be adapted for connection to a 90-degree takeoff and a straight takeoff. Preferrably, the torpedo boots, register boots, straight boots, flexible joints, solid pipes, duct runners and end caps, couplers, 90-degree takeoffs and straight takeoffs are made of a plastic material.

According to another aspect of the present invention, a complete plastic HVAC component system for distributing air and providing a tight connection between ductwork and a ducted heating or cooling system and a register to prevent loss of air while providing for ease of installation is provided. The register, straight and torpedo boots include a unitary body formed of plastic for preventing the loss of air. The unitary body has a first opening for receiving air from the pipe. The unitary body has a second opening for passing air to the register. The second opening is of a substantially rectangular shape and adapted for connection to the register. The boots are adapted to be configured to fit pipe, whether 6 inch or 7 inch in diameter. The pipe is a unitary body having a raised flange on each end and form a tight connection when connected to each other, a coupler, a straight or a 90-degree takeoff. The pipe, whether flexible or rigid, can be connected to each other by removing one of the coupling collars from an end and inserting into the end of another pipe still having the coupling collars. The 6 and 7-inch pipe connect tightly with the 6 and 7-inch collar on any of the boots, couplers or takeoffs. The takeoffs are tightly secured to the duct over top of the opening formed in the duct wall for air passage. When assembled, the components provide an efficient guide for directing air from a central unit to multiple distribution points while preventing cooling and heating efficiency losses.

DETAILED DESCRIPTION OF THE PREFERRED EMBODIMENT

Figure 1:
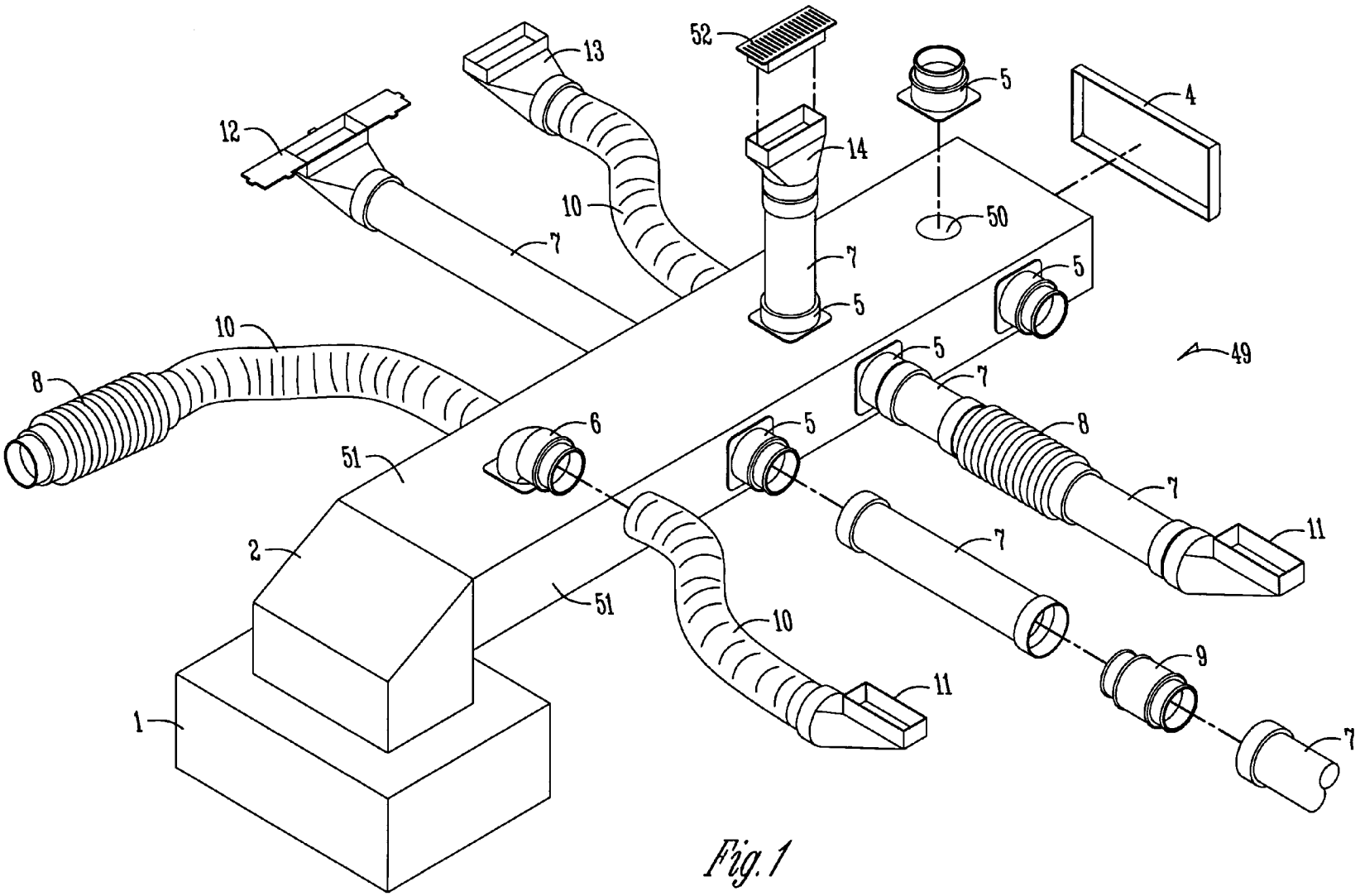
FIG. 1 is a perspective view of a system for distributing air from a central air unit to various distribution points using complimentary plastic HVAC components.

The present invention provides a complete plastic HVAC component system for distributing air and method for installing the same. FIG. 1 illustrates one embodiment of a heating and cooling system that uses various embodiments of the present invention. In FIG. 1 a furnace 1 is shown. The furnace 1 has a plenum 2 with duct 3 extending outwardly from the plenum 2. The duct 3 is capped using an end cap 4. Duct openings 50 are created on the duct wall 51. The first opening 23 of the 90-degree takeoff 6 and straight takeoff 5 are lined up flush with the duct opening 50. The flange 27 extending perpendicularly and outwardly from the first opening 23 of the takeoffs 5,6 is used to secure the takeoffs to the duct wall 51. The tight connection between the flange 27 and the duct wall 51 prevents air from passing between the flange 27 and the duct wall 51. A 6-inch diameter pipe, whether flexible 10 or rigid 7, is connected to the 6-inch integrated collar 16. A rib 22 along the collar 16 retentively engages the pipes 7, 10 and secures the pipes against air leakage and falling off. If 7-inch diameter pipes 7, 10 are used, the 6-inch integrated collar 16 is removed and the pipe is connected to the 7-inch integrated collar 17 having a rib 21 for retentively engaging the pipe. A coupler, whether rigid 9 or flexible 8, can be used to secure pipes 7,10 to each other. The couplers 8,9 have integrated collars 16, 17 for securing to both 6 or 7-inch pipes 7, 10. Additionally, ribs 21 and 22 secure the connection between the pipes 7, 10 and the collars 16, 17 from coming apart and prevent air from leaking from the connection. Torpedo 11, register 13 and straight 14 boots have integrated collars 16, 17 for connecting to both 6 and 7-inch pipes, whether flexible 10 or rigid 7 type of pipe. Both integrated collars 16, 17 have ribs 21, 22 for retentively engaging the pipe and sealing against air leakage from the first opening 23. The torpedo 11, register 13 and straight 14 boots each have a rectangular opening 25 and provide a means for attaching the boots to a register 52. Thus, air is efficiently delivered from the furnace 1 to each register 52 by traveling through the duct 3, duct opening 50, straight 5 or 90-degree 6 takeoffs, flexible 10 or rigid 7 pipes and into a torpedo 11, register 13 or straight 14 boot attached to the register 52.

Figure 2:
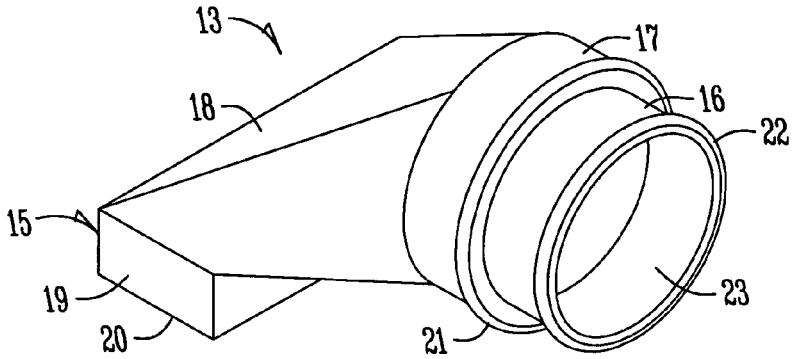
FIG. 2 illustrates a perspective view of one embodiment of a register boot of the present invention.

FIG. 2 illustrates the 90 degree regular plastic register boot 13 in greater detail. The regular plastic register boot 13 includes a unitary body 15 of plastic. The plastic is preferably an injection molded thermoplastic. The unitary body 15 has a substantially circular first opening 23 for connecting to a flexible 10 or rigid 7 pipe. The unitary body 15 also has a substantially rectangular second opening 20 for connection to a register 52. Thus air travels from the flexible 10 or rigid 7 pipe and through the first opening 23, the unitary body 15, the second opening 20 and to the register 52. Due to the unitary plastic construction, the register boot is seamless thereby preventing loss of air within the register boot itself. Thus, the unitary plastic is generally advantageous over a multi-piece construction. A multi-piece construction would also tend to increase the labor required in installing the register boot.

The unitary body 15 has integrated collars 16 and 17 for fitting the plastic register boot 13 to different sizes of diameter flexible 10 and rigid 7 pipe. For example, the collar 16 is preferably adapted to fit 6-inch diameter flexible 10 or rigid 7 pipe while the collar 17 is preferably adapted to fit 7-inch diameter flexible 10 or rigid 7 pipe. Because the unitary body is of a plastic material, the second collar 16 can be cut away from the first collar 17 as needed. This is advantageous because only one plastic register boot needs to be stocked as opposed to two plastic register boots. This same type of connection can also be used in other types of fittings as well. The first collar 16 has a first rib 22 and the second collar 17 has a second rib 21. The ribs 22, 21, assist in holding ductwork, preferably flexible 10 and rigid 7 pipe, in place.

The unitary body 15 includes a central member 18 with a rectangular mouth 19 for connection to the register 52. The central member 18 shown provides a 90 degree angle between the register 52 and the pipe 7,10. The present invention, however, contemplates that the central member 18 can be configured differently for other angles.

Figure 3:
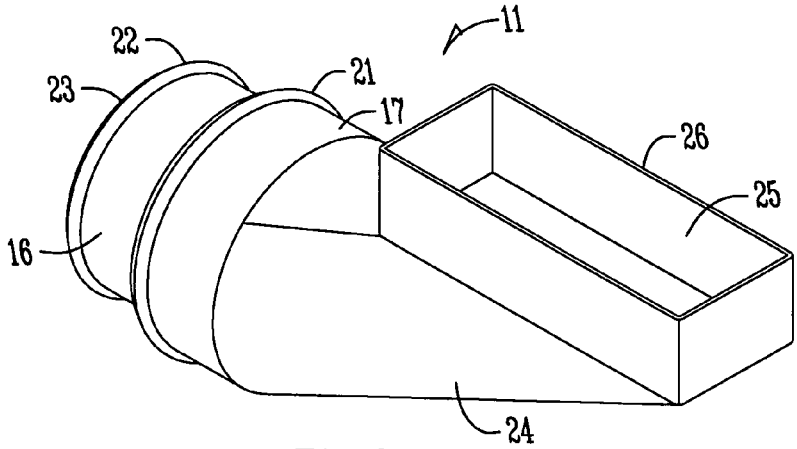
FIG. 3 illustrates a perspective view of one embodiment of a torpedo boot of the present invention.

FIG. 3 illustrate a torpedo boot embodiment of the present invention. In FIG. 3, the torpedo boot plastic register boot 11 is shown. Note that the torpedo boot is similar to the regular plastic register boot shown in FIG. 2, however, the torpedo register boot has a torpedo boot central member 24 of a different configuration. The torpedo boot 11 has a substantially rectangular opening 25 in a rectangular mouth 26 for connection to a register 52. Note that the torpedo register boot 11 is configured for a different type of connection than the register boot shown in FIG. 2 as the rectangular opening 25 is oriented differently with respect to the pipe. Also, the torpedo boot plastic register boot has a first rib 22 and a second rib 21 for assisting in the connection of pipe, preferably flexible 10 or rigid 7 pipe.

Figure 4:
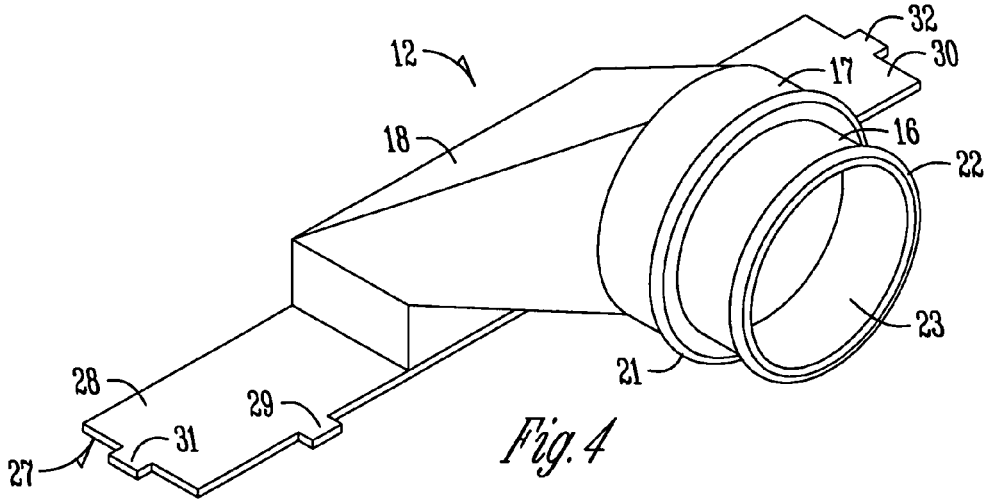
FIG. 4 illustrates a perspective view of one embodiment of a register boot with flanges of the present invention.

FIG. 4 illustrates another embodiment of a plastic register boot with a flange or lip. The plastic register boot 12 has a flange or lip 27 with a first end 28 and a second end 30 extending outwardly from the central member 33 of the plastic register boot 12. One advantage of the flange 27 is that in floor applications the flange can be used to support the plastic register boot 12 in place during the installation process. This configuration is advantageous as it allows a single person to install the plastic register boot as opposed to requiring one person to hold the register boot in place from above with a second person working from below. Thus the flange or lip 27 provides a significant savings in the labor cost associated with installation. The flange 27 also has a plurality of tabs (29, 31 and 32) to assist in holding the plastic register boot in place, particularly during the installation process. Each of the tabs (29, 31 and 32) extend outwardly from the flange 27.

Figure 5:
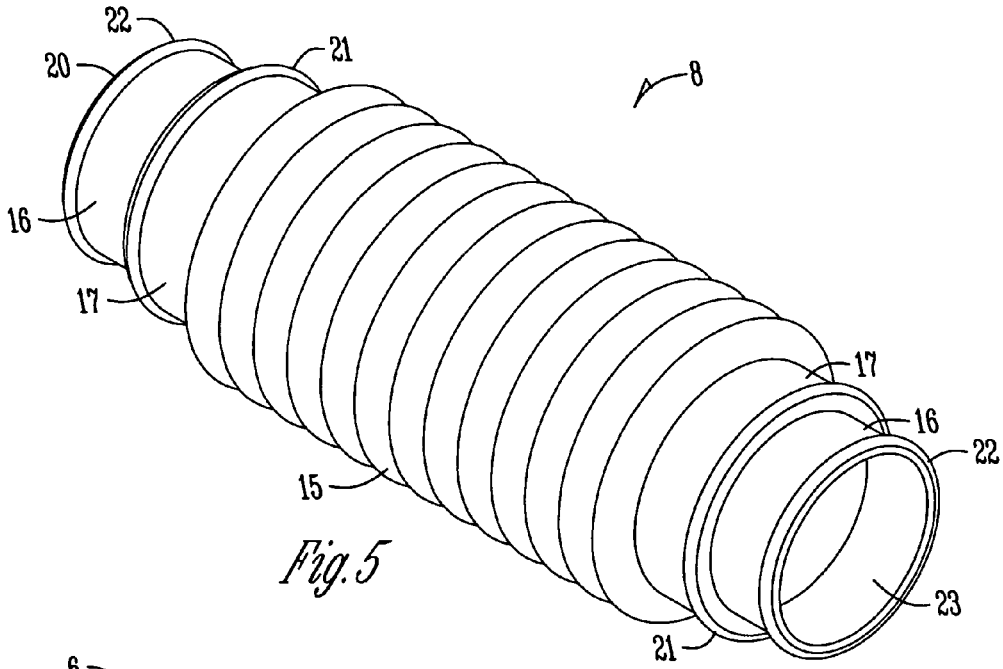
FIG. 5 illustrates a perspective view of one embodiment of a flexible coupler of the present invention.

FIG. 5 illustrates a flexible coupler of the present invention. As shown in FIG. 5, the flexible coupler 8 includes a first opening 23 and a second opening 20 on opposite ends of the flexible coupler 8. As the flexible coupler 8 is flexible, the flexible coupler 8 can be configured and bent at different angles to replace numerous types of angled joints associated with sheet metal ductwork pipes. The flexible coupler 8 is made of a plastic material and is adapted for fitting either different sizes of flexible 10 or rigid 7 pipe. Because the integral collars 16 and 17 are of different diameters, the flexible coupler can fit flexible 10 pipe and rigid 7 pipe of different diameters. For example, flexible pipe can fit a 6-inch diameter flexible 10 or rigid 7 pipe when the first collar 16 is in place. The first collar 16 can be cut away from the second collar 17 which can fit a 7-inch diameter flexible 10 or rigid 7 pipe. Due to the use of plastic material, the flexible coupler can be easily cut.

It should also be apparent that the flexible coupler 11 can fit one size of flexible 10 or rigid 7 pipe on one hand and a different size of flexible 10 or rigid 7 pipe on the other end. Thus, a single flexible coupler 11 replaces numerous types of connectors used with sheet metal. The flexible coupler 11 includes a first rib 22 and a second rib 21 to assist in connection to ductwork, especially flexible 10 or rigid 7 pipe. When connecting to flexible 10 or rigid 7 pipe, the first rib 22 or second rib 21 helps maintain a secure connection.

Figure 6:
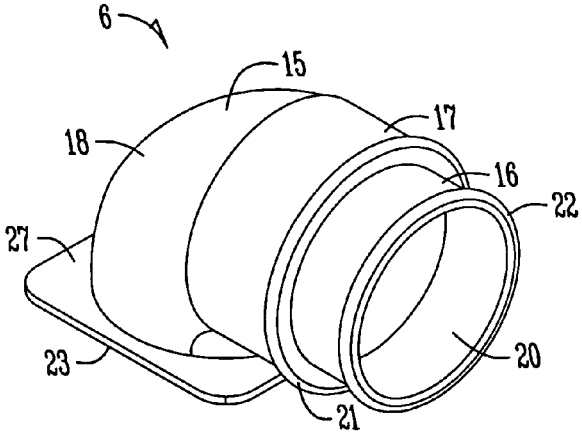
FIG. 6 illustrates a perspective view of one embodiment of a 90-degree takeoff of the present invention.

FIG. 6 illustrates the 90-degree takeoff 6 in greater detail. The 90-degree takeoff 6 includes a unitary body 15 of plastic. The plastic is preferably an injection molded thermoplastic. The unitary body 15 has a substantially circular first opening 23 with a flange 27 extending perpendicularly and outwardly therefrom for securing the first opening 23 over top of the duct opening 50 in the duct wall 51 of the duct 3. The unitary body 15 also has a substantially circular second opening 20 for connection to a flexible 10 or rigid 7 pipe. Thus air travels from the duct 3 and through the duct opening 50 and the first opening 23, the unitary body 15, the second opening 20 and to the flexible 10 or rigid 7 pipe. Due to the unitary plastic construction, the 90-degree takeoff is seamless thereby preventing loss of air within the takeoff itself. Thus, the unitary plastic is generally advantageous over a multi-piece construction. A multi-piece construction would also tend to increase the labor required in installing the 90-degree takeoff.

On the side of the second opening 20, the unitary body 15 has integrated collars 16 and 17 for fitting the 90-degree takeoff 6 to different sizes of diameter flexible 10 and rigid 7 pipe. Note that the integrated collars are identical in feature, function and dimensions as the integrated collars used on the individual register boots in FIGS. 2-4.

The 90-degree takeoff 6 insures seamless distribution of air from within a duct to the connecting pipe, whether flexible 10 and rigid 7 pipe. Because the plastic duct 3 is easily cut and does not present a sharp edge after cutting, duct openings 50 are safe to work in and around with one's bare hands. With sheet metal, duct openings create potential work hazard spots. However, the plastic duct wall 51 allows seamless implementation of takeoffs. Additionally, flange 27 insures that the first opening 23 lies flush and securely fastened to the duct wall 51 without risking injury or loss of air between the two surfaces. The 90-degree takeoff 6 a unitary body 15 includes a central member 18. The central member 18 shown provides a 90 degree angle between the duct wall 51 and the pipe 7,10. The present invention, however, contemplates that the central member 18 can be configured differently for other angles.

Figure 7:
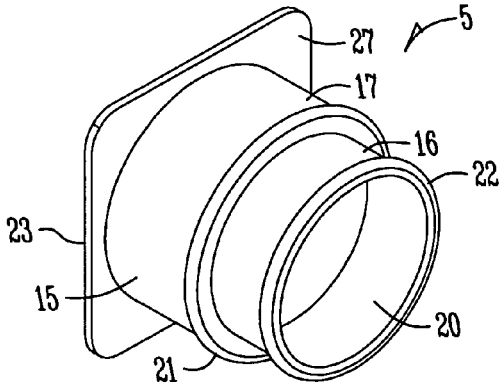
FIG. 7 illustrates a perspective view of one embodiment of a straight takeoff of the present invention.

FIG. 7 illustrates the straight takeoff 5 in greater detail. The straight takeoff 5 incorporates the identical features, functions, advantages and dimensions as the 90-degree takeoff except that the unitary body 15 is straight thereby providing a straight connection between the duct wall 51 and the pipe 7, 10.

Figure 8:
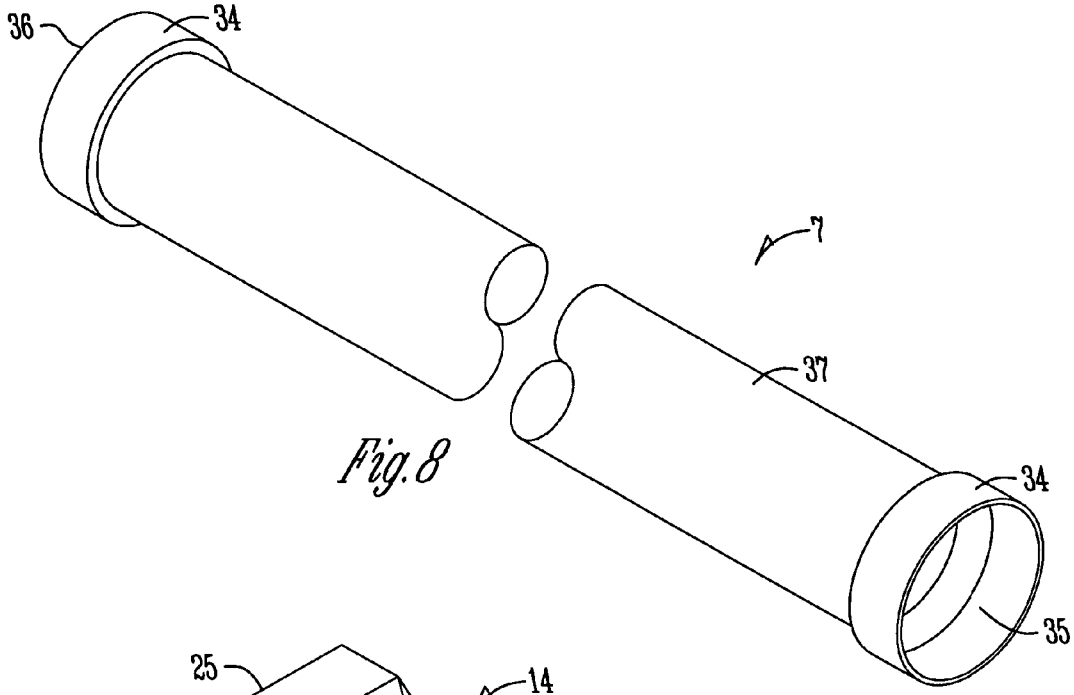
FIG. 8 illustrates a perspective view of one embodiment of a rigid pipe of the present invention.

FIG. 8 illustrates a rigid pipe of the present invention. As shown in FIG. 8, the rigid pipe 7 includes a first opening 35 and a second opening 36 on opposite ends of the pipe 7. Attached to the first 35 and second 36 opening is a coupling collar 34 for connecting to a boot, takeoff, coupler or pipe. It is preferred that the rigid pipe 7 have a 6 or 7-inch diameter. The rigid pipe 7 can be connected to another section of rigid pipe 7 having the same diameter by cutting away the coupling collar 34 on the one end of a pipe and inserting into the coupling collar 34 of another section of pipe. The rigid pipe 7 having a 6-inch diameter can be connected to the integrated collar 16 of the boot, takeoff or coupler having a similar 6-inch diameter. Additionally, the rigid pipe 7 having a 7-inch diameter can be connected to the integrated collar 17 of the boot, takeoff or coupler having a similar 7-inch diameter. The rib 22 on the integrated collar 16 and the rib 21 on the integrated collar 17 help to secure the boot, takeoff or coupler to the pipe and create a seal against air leakage.

Figure 9:
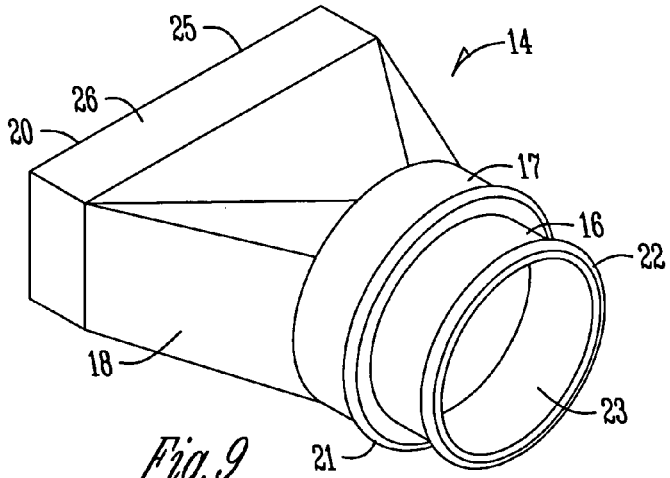
FIG. 9 illustrates a perspective view of one embodiment of a straight boot of the present invention.

FIG. 9 illustrates the straight plastic register boot 14 in greater detail. The straight plastic register boot 14 includes a unitary body 15 of plastic. The plastic is preferably an injection molded thermoplastic. The unitary body 15 has a substantially circular first opening 23 for connecting to a flexible 10 or rigid 7 pipe. The unitary body 15 also has a substantially rectangular second opening 20 for connection to a register 52. Thus air travels from the flexible 10 or rigid 7 pipe and through the first opening 23, the unitary body 15, the second opening 20 and to the register 52. Due to the unitary plastic construction, the register boot is seamless thereby preventing loss of air within the register boot itself. Thus, the unitary plastic is generally advantageous over a multi-piece construction. A multi-piece construction would also tend to increase the labor required in installing the register boot.

The unitary body 15 has integrated collars 16 and 17 for fitting the straight boot 14 to different sizes of diameter flexible 10 and rigid 7 pipe. For example, the collar 16 is preferably adapted to fit 6-inch diameter flexible 10 or rigid 7 pipe while the collar 17 is preferably adapted to fit 7-inch diameter flexible 10 or rigid 7 pipe. Because the unitary body is of a plastic material, the second collar 16 can be cut away from the first collar 17 as needed. This is advantageous because only one plastic register boot needs to be stocked as opposed to two plastic register boots. This same type of connection can also be used in other types of fittings as well. The first collar 16 has a first rib 22 and the second collar 17 has a second rib 21. The ribs 22, 21, assist in holding ductwork, preferably flexible 10 and rigid 7 pipe, in place.

The unitary body 15 includes a central member 18 with a rectangular mouth 26 for connection to the register 52. The central member 18 provides a straight connection between the register 52 and the pipe 7,10.

Figure 10:
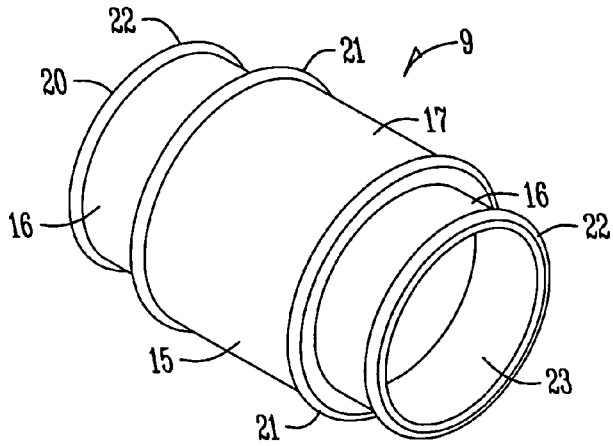
FIG. 10 illustrates a perspective view of one embodiment of a rigid coupler of the present invention.

FIG. 10 illustrates a rigid coupler of the present invention. The rigid coupler 9 is similar to the flexible coupler 8 shown in FIG. 5. Note that the difference between the flexible coupler 8 and the rigid coupler 9 is a unitary body 15 that is flexible. Particularly, the rigid coupler 9 has a rigid unitary body, whereas the flexible coupler 8 has a flexible unitary body. The rigid coupler 9 offers the benefits of rigid member. The rigid coupler 9 can also be used in situations where it supports the weight of the pipes connected thereto.

Figure 11A:
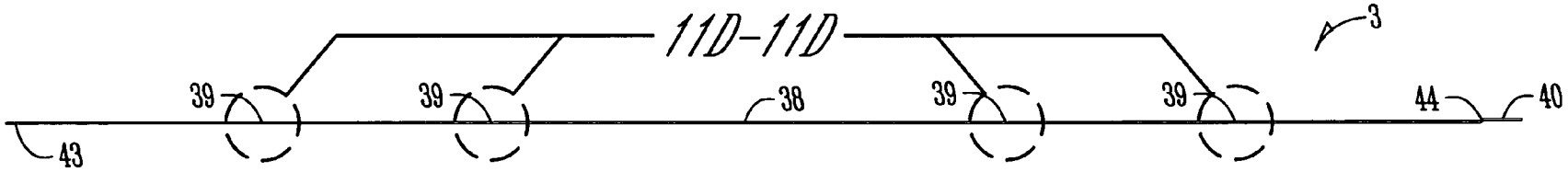
FIG. 11A illustrates a front view of one embodiment of a duct runner of the present invention prior to assembly.
Figure 11B:
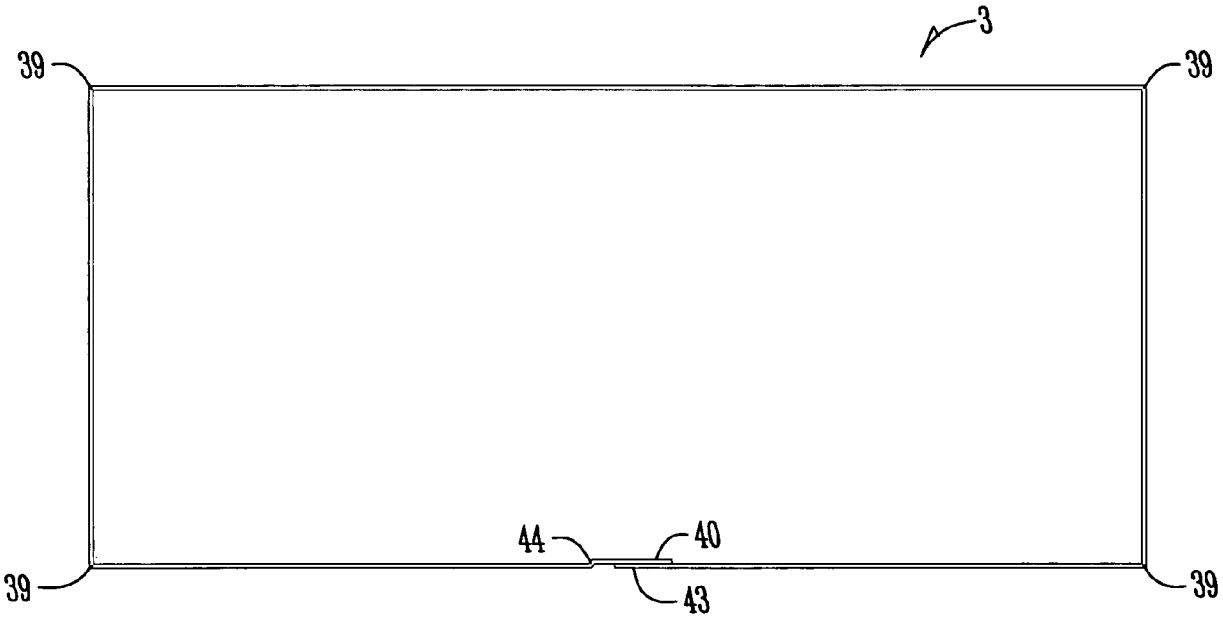
FIG. 11B illustrates a front view of one embodiment of a duct runner of the present invention after assembly and forming a rectangular duct.
Figure 11C:
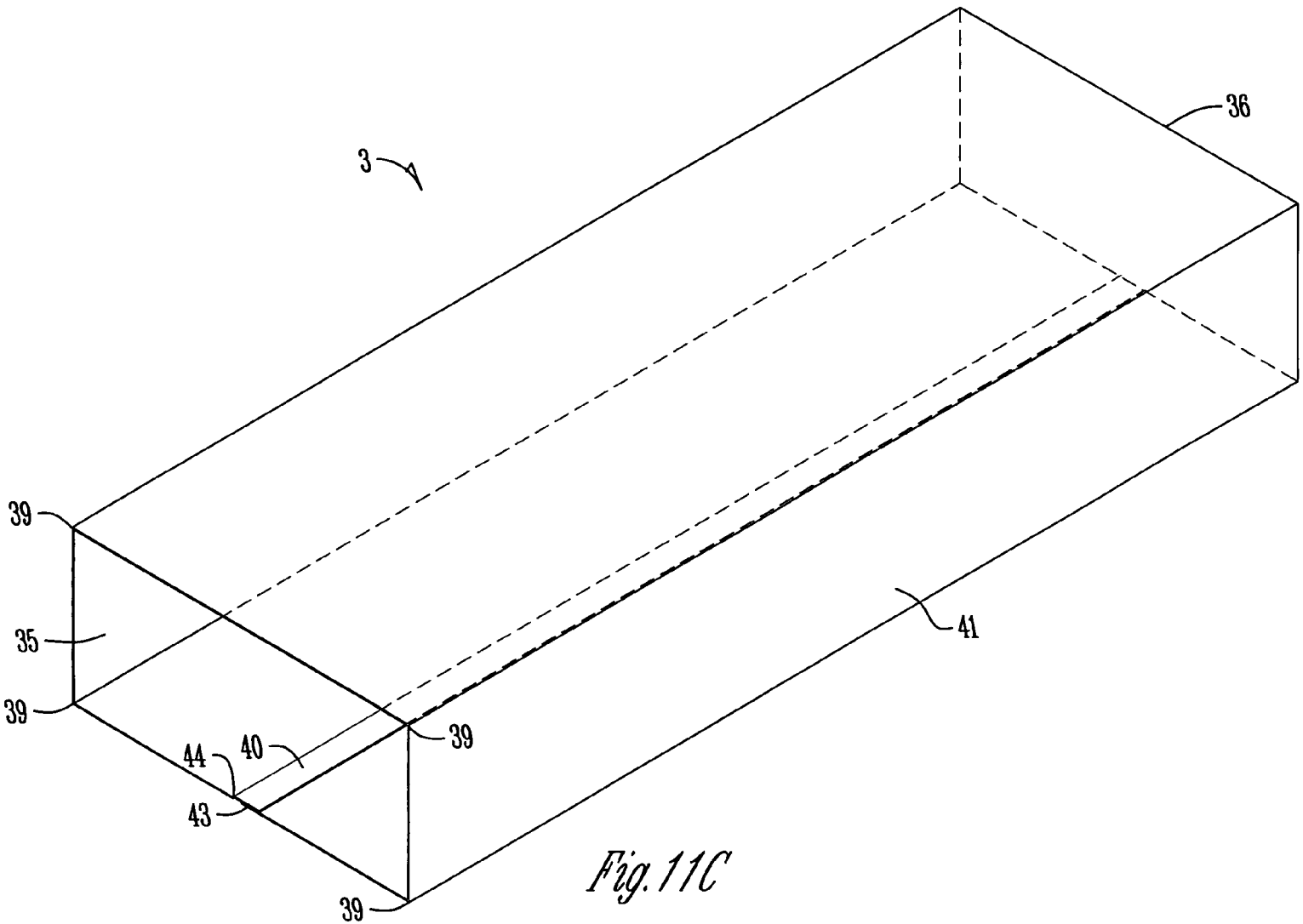
FIG. 11C illustrates a perspective view of one embodiment of a duct runner of the present invention after assembly and forming a duct.
Figure 11D:
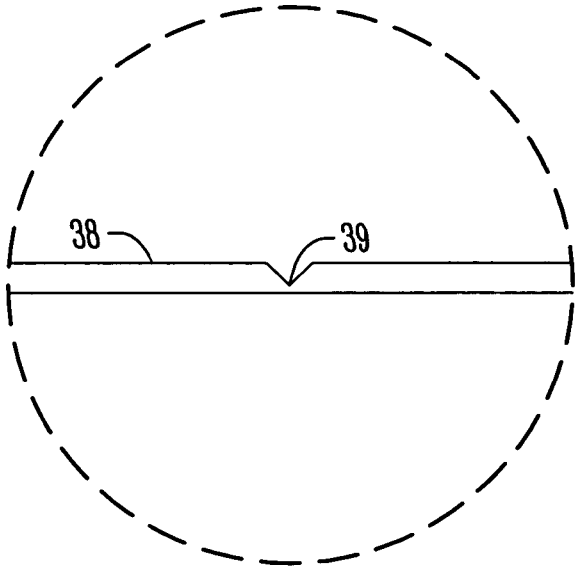
FIG. 11D illustrates a front view of the scoring of one embodiment of the duct runner in FIG. 11A taken along line 11D of the present invention.

FIGS. 11A-D illustrates a duct of the present invention. The duct 3 is assembled from a sheet of plastic having sufficient wall thickness to support its own weight after assembled and resist damage during storing, assembly and installation. Particularly, FIG. 11A shows the plastic sheet 38 having a first 44 and second 43 connecting edge. The first connecting edge 44 has a raised flange 40 connected thereto. The plastic sheet 38 has scorings 39 running parallel and the length of the sheet 38. The scorings 39 have a separation distance such that a rectangular duct shown in FIG. 11B is formed when folded along the scorings 39. The rectangular shape of the duct 3 is retained by overlapping and connecting the raised flange 37 to the second connecting edge 43. FIG. 11C illustrates the duct 3 after being constructed. The duct 3 has a rectangular body 41 connecting the first opening 35 and second opening 36. FIG. 11D illustrates the scoring 39 in the plastic sheet 38 along lines 11D as shown in FIG. 11A. The duct 3 is easy to cut to a desired length and being plastic, is also easily cut to create openings within the duct wall 51 for securing a takeoff 5, 6 thereto.

Figure 12:
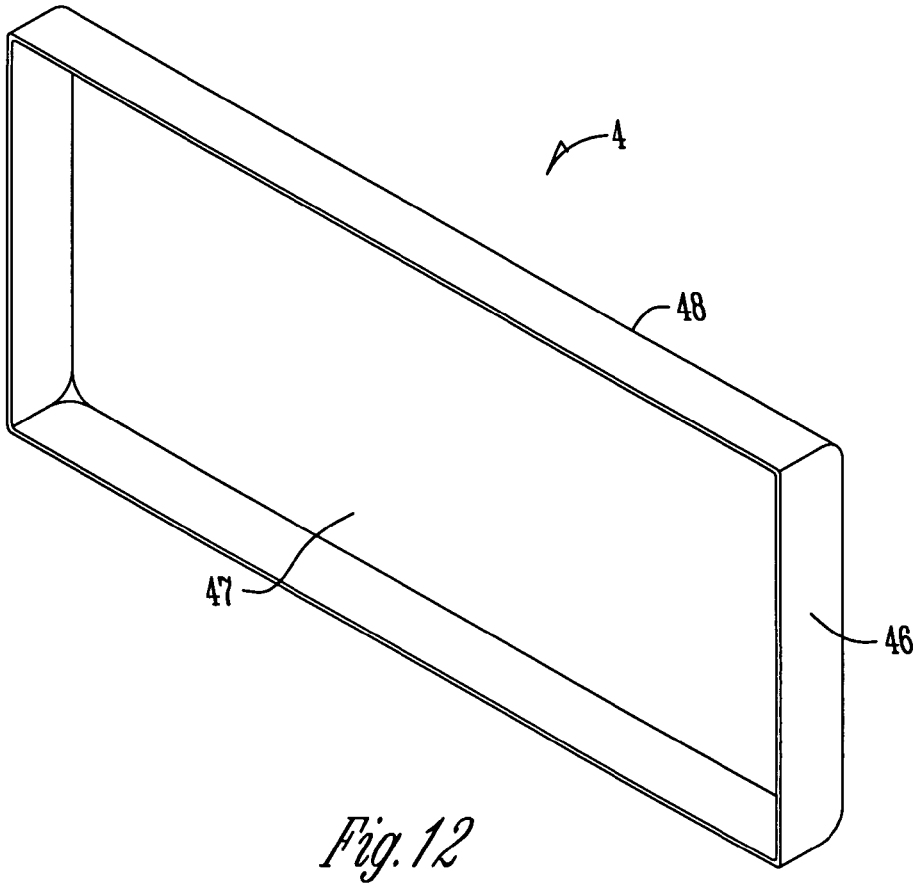
FIG. 12 illustrates a perspective view of one embodiment of a duct runner end cap of the present invention.

FIG. 12 illustrates an end cap of the present invention. The end cap is constructed of a rectangular surface 47 having an edge 48 and a wall 46. The wall 46 is connected to the edge 48 of the rectangular surface 47. The wall 46 extends perpendicularly and outwardly from the rectangular surface 47 forming a cap for closing off the end of a duct.

One skilled in the art having the benefit of this disclosure will appreciate that the present invention extends beyond the specific embodiments shown in. The present invention contemplates numerous variations in the particular type of plastic used, the manner in which the plastic if formed, the shape or configuration of the register boots, joints, or other fittings, the type of flex pipe or diameter of flex pipe that can be used, and other variations. These and other variations of the present invention are well within the spirit and scope of the invention. The present invention is not to be limited to the specific embodiments shown herein.

What is claimed is:

1. A system for distribution of air from a central air unit to multiple distribution points using complimentary components comprising:

(a) a boot having a unitary body defining an air pathway between a first and a second opening, wherein the first opening is substantially circular and the second opening is substantially rectangle for connection to a register, the unitary body further comprises a first collar of a first diameter operatively connected to a second collar of a second diameter defining the first opening, the first diameter being greater then the second diameter, the first and the second collar further comprising a first rib on the first collar and a second rib on the second collar for connecting to a pipe;

(b) a pipe having a unitary body defining an air pathway between a first and a second opening, wherein both the first and the second opening are substantially circular for connection to a boot or a takeoff, the unitary body having a first diameter operatively connected to a collar of a second diameter defining the first and the second opening, the second diameter being greater then the first diameter;

(c) a takeoff having a unitary body defining an air pathway between a first and a second opening, wherein the first opening is substantially circular for connection to a duct and the second opening is substantially circular for connection to a pipe, the unitary body further comprises a first collar of a first diameter operatively connected to a second collar of a second diameter defining the second opening, the first diameter being greater then the second diameter;

(d) a duct having a rectangular body, a length, a first and a second connecting edge and a raised flange along the length of the first connecting edge, a set of scorings spaced apart and running parallel the length of the body, a first and a second opening formed by folding the body along the scorings and overlapping the raised flange and the second connecting edge, the rectangular body defining an air pathway between the first and the second opening wherein the first and the second opening are substantially rectangular for connection to a central unit, an end cap or a duct; and (e) an end cap having a rectangular surface supported peripherally by an edge and a wall, the wall extending perpendicularly and outwardly from the rectangular surface for closing off the end of a duct.

2. The duct of claim 1 wherein first opening is connected to the central air unit and the second opening to the end cap.

3. The duct of claim 2 wherein a hole is cut, the hole having a diameter equal to the first diameter of the takeoff, the first opening of the takeoff being secured over the hole in the duct, the pipe being secured tightly to the second opening of the takeoff, the first opening of the boot being secured tightly to the pipe and a register being secured tightly to the second opening of the boot for distributing air from the central air unit to the register.

4. The duct of claim 3 wherein tight connection between the duct, takeoffs, pipe, boots and registers prevents loss of air and increases efficiency.

5. The pipe of claim 1 wherein the unitary body is either flexible or rigid.

6. The boot of claim 1 wherein the second collar is adapted to fit a 6 inch diameter pipe when the first collar is removed, the first collar is adapted to fit a 7 inch diameter pipe.

7. The boot of claim 1 wherein the second opening is manufactured to accommodate registers having different widths and lengths.

8. The boot of claim 1 wherein the first opening defines a first plane perpendicular to a second plane defined by the second opening.

9. The boot of claim 1 wherein the first opening defines a first plane parallel to a second plane defined by the second opening.

10. The takeoff of claim 1 wherein the first opening defines a first plane perpendicular to a second plane defined by the second opening.

11. The takeoff of claim 1 wherein the first opening defines a first plane parallel to a second plane defined by the second opening.

12. The takeoff of claim 1 further comprising a flange extending outwardly from the first opening to connect the takeoff to the duct.

13. The system of claim 1 wherein the boot, pipe, takeoff, duct and end cap are a thermoplastic.

14. The system of claim 1 wherein the boot, pipe, takeoff, duct and end cap are formed by injection molding.

15. The system of claim 1 wherein the register boot further comprises a flange extending outwardly from the second opening to support the register boot.

16. The register boot of claim 8 further comprising a plurality of tabs extending outwardly from the flange for assisting in installation of the register boot in a floor.

* * * * *